US011344459B2

(12) United States Patent
Jähkel et al.

(10) Patent No.: US 11,344,459 B2
(45) Date of Patent: May 31, 2022

(54) TILT ASSEMBLY FOR A POWERED WHEELCHAIR AND A POWERED WHEELCHAIR COMPRISING THE SAME

(71) Applicant: Permobil AB, Timrå (SE)

(72) Inventors: Jonas Jähkel, Stockholm (SE); Mehdi Mirzaie, Brentwood, TN (US)

(73) Assignee: Permobil AB

( * ) Notice: Subject to any disclaimer, the term of this patent is extended or adjusted under 35 U.S.C. 154(b) by 0 days.

(21) Appl. No.: 16/497,003

(22) PCT Filed: Mar. 28, 2018

(86) PCT No.: PCT/EP2018/057929
§ 371 (c)(1),
(2) Date: Sep. 24, 2019

(87) PCT Pub. No.: WO2018/178156
PCT Pub. Date: Oct. 4, 2018

(65) Prior Publication Data

US 2020/0093666 A1 Mar. 26, 2020

(30) Foreign Application Priority Data

Mar. 31, 2017 (SE) ..... 1750395-4

(51) Int. Cl.
*A61G 5/10* (2006.01)
*A61G 5/04* (2013.01)

(52) U.S. Cl.
CPC ..... *A61G 5/1075* (2013.01); *A61G 5/04* (2013.01); *A61G 5/1059* (2013.01)

(58) Field of Classification Search
CPC ..... A61G 5/1075; A61G 5/04; A61G 5/1059; A61G 5/1056; A61G 5/107; A47C 1/024;
(Continued)

(56) References Cited

U.S. PATENT DOCUMENTS 4,589,697 A * 5/1986 Bauer ..... A47C 1/022 297/301.2
4,884,841 A 12/1989 Holley
(Continued)

FOREIGN PATENT DOCUMENTS

CN 1392788 A 1/2003
CN 1893857 A 1/2007
(Continued)

OTHER PUBLICATIONS

PCT International Search Report for International Application No. PCT/EP2018/057929, dated Jun. 13, 2018.
(Continued)

*Primary Examiner* — Mark R Wendell
(74) *Attorney, Agent, or Firm* — McAndrews, Held & Malloy, Ltd.

(57) ABSTRACT

The present disclosure relates to a tilt assembly (1) for a powered wheelchair (15), comprising: an elongated base member (3) provided with an axial channel, a lifting member (5) configured to be received by the base member (3) and to move rectilinearly in the channel, between a retracted position and an extended position relative to the base member (3), a tilt frame (7) pivotally connected to the lifting member (5), the tilt frame (7) being configured for mounting a seat assembly (21) thereto, and an actuator arm (9) pivotally connected to the base member (3) and to the tilt frame (7), the actuator arm (9) being configured to be actuated between a retracted actuator position and a fully extended actuator position, wherein the tilt frame (7) is configured to obtain a perpendicular orientation relative to a central axis (11) of the lifting member (5) when the lifting member (5) is in the retracted position and the actuator arm is in the retracted actuator position and to be inclined relative to the central axis (11) when the lifting member (5) is in an extended
(Continued)

position and actuator arm is in the retracted actuator position, to thereby provide a tilt functionality.

12 Claims, 3 Drawing Sheets

(58) Field of Classification Search
CPC ..... A47C 1/0242; A47C 1/02; A47C 1/022; A47C 1/025
USPC ..... 297/325
See application file for complete search history.

(56) References Cited

U.S. PATENT DOCUMENTS

| | | | | | |
|---|---|---|---|---|---|
| 5,063,617 | A * | 11/1991 | Ward | A61G 7/1017 | 4/667 |
| 5,690,185 | A * | 11/1997 | Sengel | A61G 5/046 | 180/65.1 |
| 6,438,769 | B1 * | 8/2002 | Luckenbill | A61G 7/1007 | 297/183.9 |
| 6,447,064 | B1 * | 9/2002 | Mundy | A61G 5/00 | 297/313 |
| 6,640,363 | B1 | 11/2003 | Pattee et al. | | |
| 9,301,896 | B2 * | 4/2016 | Hsieh | A61G 7/1019 | |
| 10,568,790 | B2 * | 2/2020 | Jahkel | A61G 5/1075 | |
| 10,702,430 | B2 * | 7/2020 | Jahkel | A61G 5/1075 | |
| 2012/0292877 | A1 | 11/2012 | Johansson et al. | | |
| 2014/0262566 | A1 * | 9/2014 | Davis | A61G 5/1059 | 180/54.1 |
| 2015/0015043 | A1 * | 1/2015 | Jahkel | A47C 1/02 | 297/326 |

FOREIGN PATENT DOCUMENTS

| | | | | |
|---|---|---|---|---|
| CN | 102160717 | A | | 8/2011 |
| CN | 105125356 | | * | 9/2015 |
| CN | 105392458 | A | | 3/2016 |
| CN | 105705062 | A | | 6/2016 |
| DE | 8805510 | | | 6/1988 |
| DE | 202007018454 | U | | 9/2008 |
| DE | 202013002877 | | | 5/2013 |
| DE | 202013002887 | | | 6/2014 |
| EP | 1506760 | A1 | | 2/2005 |
| EP | 1917946 | A2 | | 5/2008 |
| EP | 2823796 | A1 | | 1/2015 |
| EP | 3381429 | B1 | | 6/2020 |
| FR | 3005851 | | | 11/2014 |
| JP | 2007209687 | A | | 8/2007 |
| JP | 2015070950 | | * | 4/2015 |
| WO | 2006047342 | A2 | | 5/2006 |
| WO | 2013066198 | A1 | | 5/2013 |

OTHER PUBLICATIONS

PCT Written Opinion of the International Search Authority for International Application No. PCT/EP2018/057929, dated Jun. 13, 2018.
Office Action for Swedish Patent Application No. 1750395-4, dated Oct. 31, 2017, 5 pages.
Search Report for Swedish Patent Application No. 1750395-4, dated Oct. 31, 2017, 3 pages.
European Patent Office Communication for Application No. 18716167.4, dated Dec. 18, 2020, 23 pages.
Office Action for Swedish Patent Application No. 1750395-4, dated Feb. 26, 2019, 5 pages.
First Office Action and Search Report for Chinese Patent Application No. 201880020975 7, dated Apr. 6, 2021, 18 pages.

* cited by examiner

TILT ASSEMBLY FOR A POWERED WHEELCHAIR AND A POWERED WHEELCHAIR COMPRISING THE SAME

CROSS-REFERENCE TO RELATED APPLICATIONS/INCORPORATION BY REFERENCE

The present application is the U.S. national phase under § 371 of International Application No. PCT/EP2018/057929, having an international filing date of Mar. 28, 2018, which claims priority to SE Patent Application No. 1750395-4, filed Mar. 31, 2017. Each of the above-mentioned prior-filed applications is hereby expressly incorporated herein by reference in its entirety.

TECHNICAL FIELD

The present disclosure generally relates to a tilt assembly for a powered wheelchair. In particular, it relates to a tilt assembly which is configured to provide tilting and lifting of a seat assembly of a powered wheelchair, and to a powered wheelchair.

BACKGROUND

Powered wheelchairs are commonly fitted with a tilt/lift arrangement which allows adjustment of the orientation and/or the height of the wheelchair seat. Such adjustment may be anterior, i.e. forward, or posterior, i.e. backwards tilting, and/or lifting of the seat. Commonly, tilting is referred to as the operation that affects the orientation of the seat while lifting affects the height of the seat. A seat occupant or caretaker may thereby for example set the seat position according to desire or current need of the occupant. Some examples of reasons for adjusting the seat position include achieving pressure relief, resting in general, the ability to better reach things or otherwise accommodate to the environment. Moreover, adjustment of the seat height and orientation may be a desirable feature for control purposes to stabilise the wheelchair depending on speed and travel on inclined surfaces.

An example of a wheelchair with tilt and lift capabilities is disclosed in EP2823796 A1. The powered wheelchair comprises a chassis frame, a lift device having a base member which is fixedly arranged to the chassis frame, and a lifting member arranged to move rectilinearly relative to the base member along an axis defined by a longitudinal extension of the lifting member, a tilt frame, a first arm pivotally coupled to the lifting member and the tilt frame, and a second arm coupled to the base member, and which second arm is pivotally coupled to the first arm forming a pivot connection, wherein movement of the lifting member towards the extended position moves the pivot connection towards the base member and movement of the lifting member towards the retracted position moves the pivot connection away from the base member.

U.S. Pat. No. 6,447,064 B1 discloses a wheelchair with a tiltable seat. The wheelchair has a tilt fulcrum between 3 and 7 inches from the front edge of the seat pan and between 1 and 4 inches below the surface of the seat pan. This minimizes the elevation of the rider's knees when in a tilted position, and allows for more stability and a shorter wheel base. Manual self-tilting is facilitated by a gas strut arrangement disposed on brackets below the seat pan, and operated by a rider-controlled valve.

SUMMARY

In the case of U.S. Pat. No. 6,447,064 B1, the elevation of the knees is minimised during tilting, because the gas strut is retracted to obtain a tilt position. The tilt frame is arranged horizontal when the gas strut is extended. This wheelchair is a manual wheelchair, which allows a design which lowers the back edge of the tilt frame to perform tilt. Powered wheelchairs on the other hand typically have batteries arranged below the seat limiting the amount of space available for tilt operations. This essentially renders implementation of the tilt functionality as disclosed in U.S. Pat. No. 6,447,064 B1 impossible.

The tilt and lift functionality of EP2823796 A1 provides an anterior/posterior tilt functionality for a powered wheelchair, but has a rather complex design.

In view of the above, a general object of the present disclosure is to provide a tilt assembly which solves or at least mitigates the problems of the prior art.

According to a first aspect of the present disclosure there is provided a tilt assembly for a powered wheelchair, comprising: an elongated base member provided with an axial channel, a lifting member configured to be received by the base member and to move rectilinearly in the channel, between a retracted position and an extended position relative to the base member, a tilt frame pivotally connected to the lifting member, the tilt frame being configured for mounting a seat assembly thereto, and an actuator arm pivotally connected to the base member and to the tilt frame, the actuator arm being configured to be actuated between a retracted actuator position and a fully extended actuator position, wherein the tilt frame is configured to obtain a perpendicular orientation relative to a central axis of the lifting member when the lifting member is in the retracted position and the actuator arm is in the retracted actuator position and to be inclined relative to the central axis when the lifting member is in an extended position and the actuator arm is in the retracted position, to thereby provide a tilt functionality.

An effect which may be obtainable thereby is a simple tilt function design which during tilt provides a negligible change of the point of gravity of a wheelchair occupant, resulting in good stability of a powered wheelchair during tilt.

Moreover, by means of the actuator arm more advanced tilting options may be provided, for example both posterior and anterior tilt, and even a lift functionality, using only a few components.

According to one embodiment the tilt frame is configured to obtain an inclined position relative to the central axis when the lifting member is in the retracted position and the actuator arm is in an extended position.

According to one embodiment the tilt frame is configured to obtain a perpendicular orientation relative to the central axis when the lifting member is in a fully extended position and the actuator arm is in the fully extended actuator position.

According to one embodiment the base member is configured to be immovably mounted to a chassis frame of a powered wheelchair.

According to one embodiment the actuator arm has a first end which is pivotally connected to the base member and a second end which is pivotally connected to the tilt frame.

According to one embodiment the tilt frame has an essentially planar surface configured for mounting a seat assembly of a powered wheelchair thereto.

According to one embodiment the pivot connection between the lifting member and the tilt frame is aligned with a central axis of the lifting member.

According to one embodiment the actuator arm is configured to provide a controlled degree of tilt per height unit of movement of the lifting member.

There is according to a second aspect of the present disclosure provided a powered wheelchair comprising: a chassis frame, and a tilt assembly according to the first aspect.

According to one embodiment the base member is immovably mounted to the chassis frame.

According to one embodiment the base member has a central axis which is oriented vertically when the powered wheelchair is arranged horizontally on a planar surface.

One embodiment comprises a seat assembly, wherein the seat assembly is mounted to the tilt frame.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
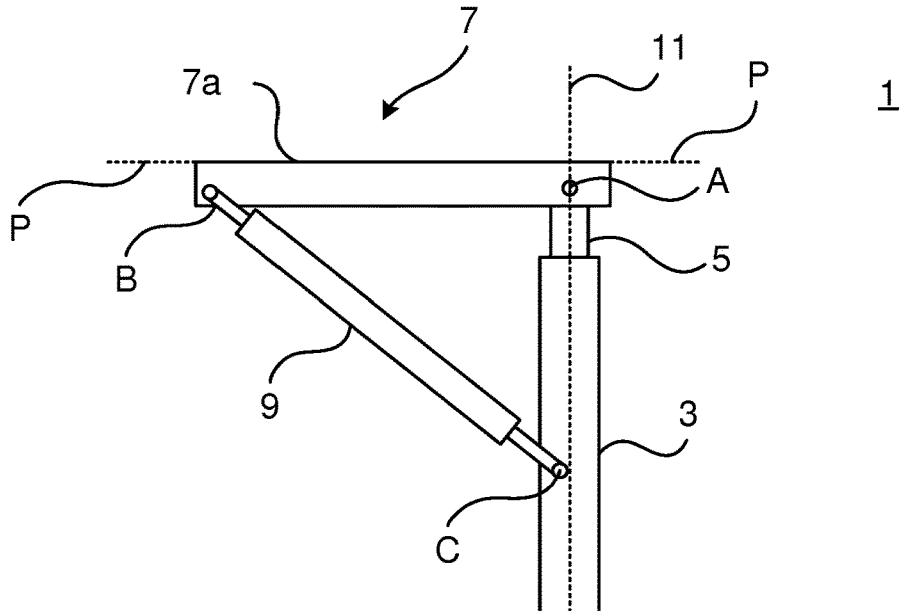
FIG. 1 schematically shows a side view of an example of tilt assembly in a default non-tilting and non-lifted position.

FIG. 1 shows an example of a tilt assembly 1 for a powered wheelchair, in a default non-tilting and non-lifted position or state. In the default non-tilting and non-lifted position of the tilt assembly 1, no tilt and no lift functionality is provided by the tilt assembly 1.

The tilt assembly 1 comprises an elongated base member 3, a lifting member 5, a tilt frame 7 and an actuator arm 9.

The base member 3 is configured to receive the lifting member 5. Hereto, the base member 3 is provided with an axial channel in which the lifting member 5 is configured to be received. The lifting member 5 is configured to move rectilinearly relative to the base member 3, in the axial channel, between a retracted position relative to the base member and an extended position relative to the base member 3. The lifting member 5 and the base member 3 are hence concentrically arranged. In the retracted position, the lifting member 5 is received maximally by the base member 3, as shown in FIG. 1. In this case, the lifting member 5 is not able to be received further by the base member 3. In the extended position, the lifting member 5 extends or protrudes from the base member 3 more than in the retracted position.

The lifting member 5 may according to one variation be configured to be actuated between the retracted position and an extended position by means of a motor.

The base member 3 may according to one variation be configured to be immovably attached or mounted to a chassis frame of a powered wheelchair. The base member 3 is in this case, when mounted to the chassis frame, immovably arranged relative to the chassis frame.

The base member 3 is arranged to extend in a vertical plane when the tilt assembly 1 is mounted to a chassis frame and the powered wheelchair is placed on a horizontal support surface.

The tilt frame 7 is configured to allow a seat assembly to be mounted to the tilt frame 7. The tilt frame 7 is provided with an essentially planar surface, or a planar surface, 7*a* to which a seat assembly may be mounted. This essentially planar or planar surface 7*a* is typically an upper surface of the tilt frame 7. The upper surface is a surface which faces away from the base member 3 and the lifting member 5 and which is intersected by a central axis 11 defined by the longitudinal extension of the lifting member 5.

The tilt frame 7 is pivotally connected to the lifting member 5. The tilt frame 7 is hence pivotable relative to the lifting member 5 about a pivot axis formed by the pivot connection A between the tilt frame 7 and the lifting member 5. The pivot connection A allows the tilt frame 7 to be moved relative to the base member 3 when the lifting member 5 is moved between the retracted and an extended position.

According to the example shown in FIG. 1, the tilt frame 7 is arranged asymmetrically relative to the central axis 11. The majority of the tilt frame 7 has an extension on one side of the central axis 11. The pivot connection B between the tilt frame 7 and the actuator arm 9 is located on that side of the central axis 11 on which the majority of the tilt frame 7 extends. The pivot connection A, which defines the pivot connection between the lifting member 5 and the tilt frame 7 is preferably arranged aligned with the central axis 11.

The actuator arm 9 extends between the base member 3 and the tilt frame 7. The actuator arm 9 is pivotally connected to the tilt frame 7 and to the base member 3. The tilt frame 7 is hence pivotable relative to the actuator arm 9 about a pivot axis formed by the pivot connection B between the actuator arm 9 and the tilt frame 7. Moreover, the actuator arm 9 is pivotable relative to the base member 5 about a pivot axis formed by the pivot connection C between the actuator arm 9 and the base member 5. According to one variation, the pivot connection B forms one end of the actuator arm 9 and the pivot connection C forms the other end of the actuator arm 9.

The actuator arm 9 is configured to be actuated or maneuvered between a retracted actuator position and a fully extended actuator position. The actuator arm 9 is thereby able to control the pivot position of the tilt frame 7 about the pivot connection A. The actuator arm 9 may be configured to obtain a plurality of positions between the retracted actuator position and the fully extended actuator position. The amount of extension relative to the retracted actuator position is one variable for providing tilt/lift of the tilt assembly 1. Another variable is the amount of extension/retraction of the lifting member 5. By means of the combination of positions of these two extensible/retractable components posterior tilt, anterior tilt and lift may be obtained, as will be explained in more detail below.

As shown in FIG. 1, when the lifting member 5 is in the retracted position and the actuator arm 9 is in the retracted actuator position, the tilt frame 7 is arranged perpendicular to the central axis 11. In particular, the essentially planar surface 7*a* of the tilt frame 7 defines a plane P which is arranged perpendicular to the central axis 11 and the central axis 11 intersects the plane P.

Figure 2:
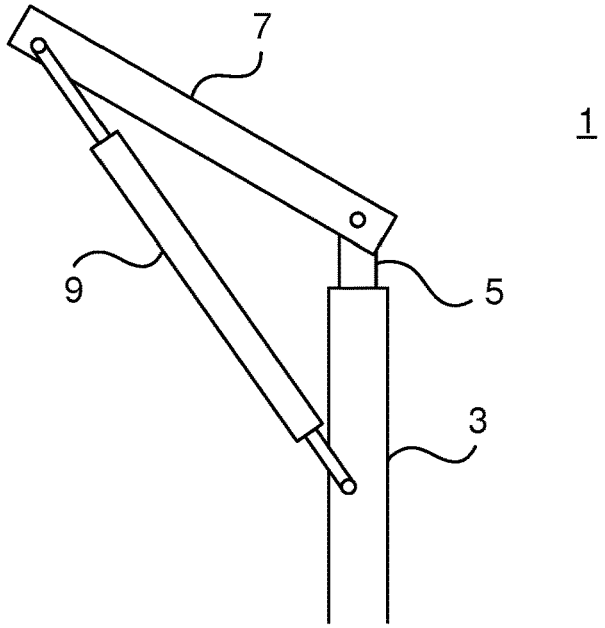
FIG. 2 schematically shows a side view of the tilt assembly in FIG. 1 in an anterior tilt position.

Turning to FIG. 2, the tilt assembly 1 is shown having a tilting position or state. The tilting position or state is in this case an anterior tilt position. The tilt assembly 1 is hence configured to provide forward tilt functionality when mounted to a powered wheelchair. The lifting member 5 is in the example shown in FIG. 2 in the retracted position and the actuator arm 9 is in the fully extended actuator position. Maximal anterior tilt is thereby obtained. A plurality of different anterior tilt positions of the tilt frame 7 may be obtained, depending on the degree of extension of the actuator arm 9.

Figure 3:
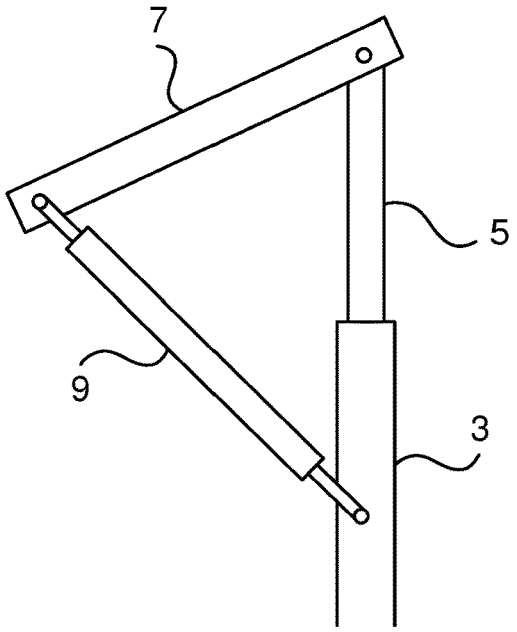
FIG. 3 schematically shows a side view of the tilt assembly in FIG. 1 in a posterior tilt position.

FIG. 3 depicts another tilt position of the tilt assembly 1. The tilting position is in this case posterior or backwards tilt. Posterior tilting can be provided by movement of the lifting member 5 from its retracted position relative to the base member 3 to an extended position relative to the base member 3 while the actuator arm 9 is not in the fully extended actuator position or in any other intermediate position which in combination with the degree of extension of the lifting member 3 provides a lift functionality.

According to one example, for each extended position of the lifting member 5, the actuator arm 9 may obtain a position between the retracted actuator position and the fully extended actuator position such that the essentially planar surface 7*a* of the tilt frame 7 defines a plane P which is arranged perpendicular to the central axis 11 and the central axis 11 intersects the plane P. Such an intermediate position of the actuator arm 9 is in the following referred to as a lift position. When the lifting member 5 is in an extended position and the actuator arm 9 is not in a lift position, the tilt frame 7 is inclined relative to the central axis 11.

Movement of the lifting member 5 towards the extended position causes the tilt frame 7 to be moved away from the base member 3. Movement of the lifting member 5 towards the retracted position causes the tilt frame 7 to be moved towards the base member 3. The pivot connection A is translated only rectilinearly when the lifting member 5 is moved between the retracted position and the extended position. In the case of posterior tilting, the pivot connection B is moved along an arc which has a radius defined by the distance between pivot connections B and C when the lifting member 5 is moved between the retracted and an extended position. This movement along the arc contributes to reducing or minimizing the change of the centre of gravity of the user during a tilt operation.

The amount of posterior tilt, or the posterior tilt angle, of the tilt frame 7 of an assembled tilt assembly 1 is determined by the amount that the lifting member 5 is moved from the retracted position and the degree of extension of the actuator arm 9. The amount of posterior tilt is hence determined by the position of the pivot connection A along the central axis 11 and by the distance between the pivot connections B and C. Maximal posterior tilt is obtained when the lifting member 5 reaches its maximally extended position relative to the base member 3 and the actuator arm 9 is in the retracted actuator position.

Figure 4:
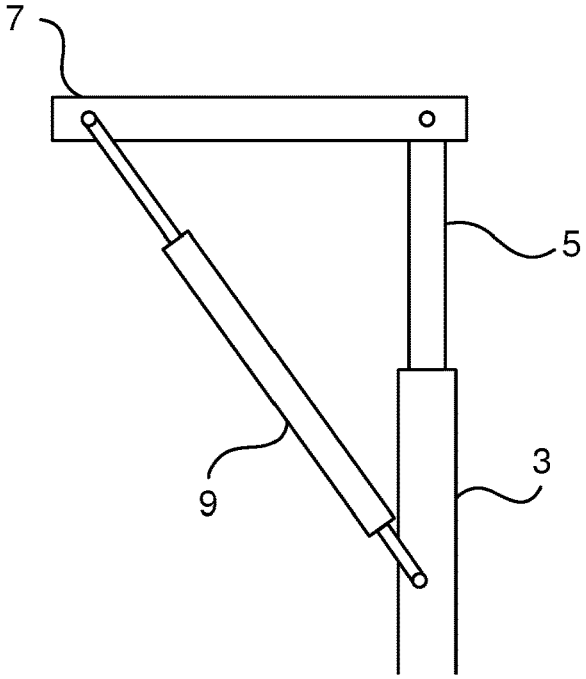
FIG. 4 schematically shows a side view of the tilt assembly in FIG. 1 in a lifted position.

FIG. 4 shows an example when the tilt assembly 1 is in a lifted position or state. In a lifted position of the tilt frame 7, the essentially planar surface 7*a* of the tilt frame 7 defines a plane P which is arranged perpendicular to the central axis 11 and the central axis 11 intersects the plane P. In the example shown in FIG. 4, the lifting member 5 is in the fully extended position and the actuator arm 9 is in the fully extended actuator position. This is according to the present example the combination which provides the maximum lift of the tilt frame 7. The maximum lift may for some examples of the tilt assembly not occur when both the lifting member and the actuator arm are in their respective fully extended position, as this depends on the stroke lengths of the lifting member and of the actuator arm. In these cases full extension of the lifting member and full extension of the actuator arm may instead lead to an anterior tilt position or posterior tilt position of the tilt frame. As previously mentioned, a plurality of other lift positions may be obtained by suitable combinations of extension of the lift member 5 and the actuator arm 9.

The actuator arm 9 provides a controlled tilting of the tilt frame 7. The actuator arm 9 provides a controlled degree of tilt per height unit of movement of the lifting member 5. If no actuator arm would be provided, the tilt frame would tilt uncontrollably to obtain a state of posterior tilt or anterior tilt depending on e.g. the centre of gravity and/or the weight of a seat occupant of a seat assembly mounted to the tilt frame. The maximal tilt that can be provided by the tilt assembly 1 is determined by the position of the pivot connection B along the tilt frame 7, the position of the pivot connection C along the base member 3, and on the length of the actuator arm 9.

The tilt assembly 1 may according to one variation comprise a resilient member. The resilient member is in this case configured to provide damping of the tilt frame 7. The resilient member may for example be a spring, in which case the actuator arm 9 and the resilient member 13 may form a strut, or it may be a resilient bushing or a resilient sleeve attached to an end of the actuator arm 9, and which is able to expand and contract in the longitudinal direction of the actuator arm 9. The resilient member may in this case for example be made of a polymeric material.

Figure 5:
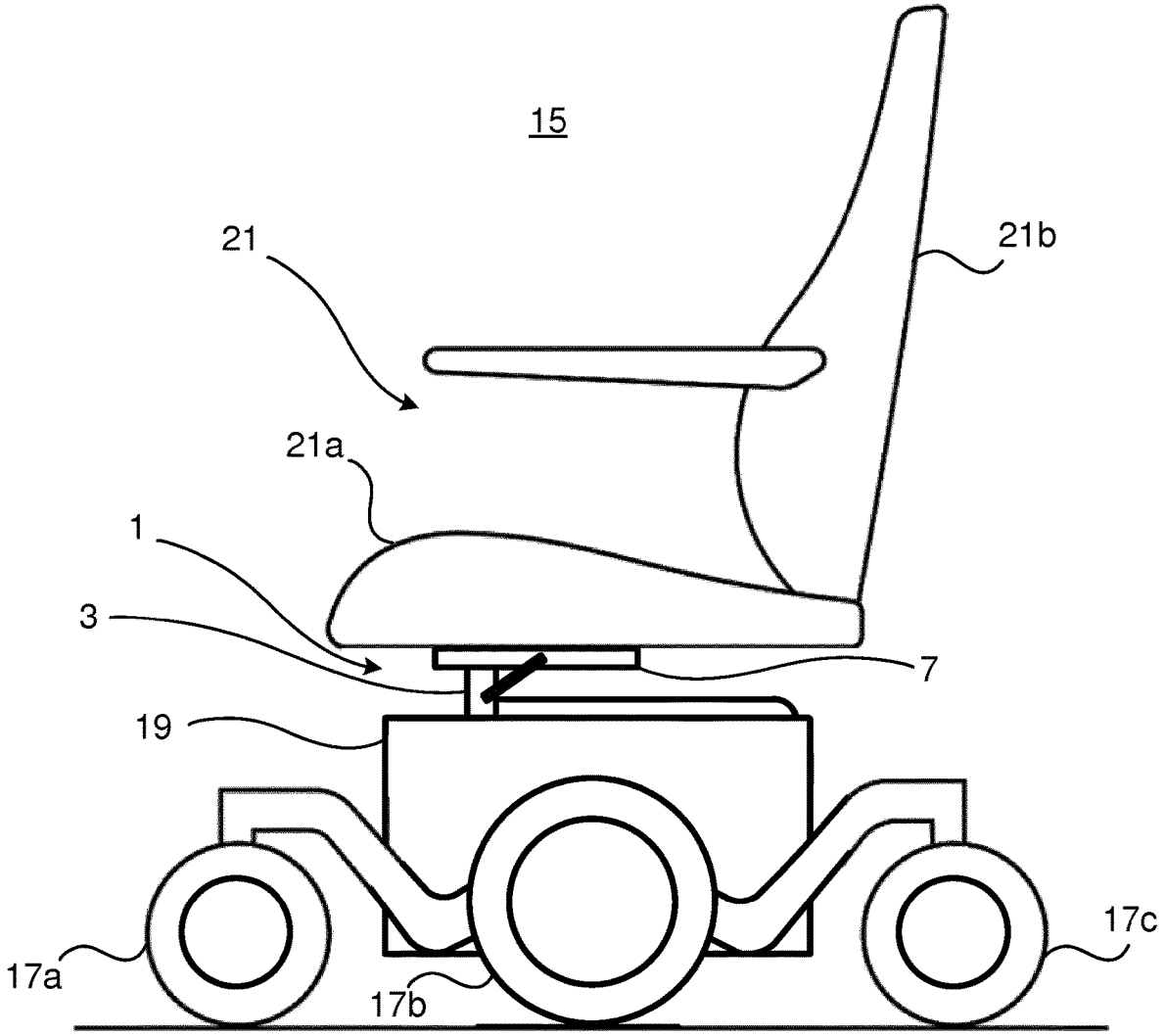
FIG. 5 shows a powered wheelchair comprising the tilt assembly in FIG. 1.

FIG. 5 shows an example of a powered wheelchair 15. The exemplified powered wheelchair 15 is a mid-wheel drive wheelchair, but could alternatively be a front-wheel drive wheelchair or a rear-wheel drive wheelchair.

The powered wheelchair 15 comprises a plurality of wheels 17*a*-17*c*. In the present example there are two front caster wheels 17*a*, two drive wheels 17*b* and two rear caster wheels 17*c*. The powered wheelchair 11 furthermore comprises a chassis frame 19 on which at least one battery, not shown, is mounted for driving the drive wheels 17*b*, and the tilt assembly 1. The tilt assembly 1 is mounted to the chassis frame 19. According to the present example, the tilt assembly 1 is mounted to the chassis frame 19 in front of the at least one battery. The base member 3 is located centred between the two drive wheels 17*b* in a direction from one of the drive wheels 17*b* to the other drive wheel 17*b*.

When the tilt assembly 1 is mounted to the chassis frame 19, the pivot connection A is located closer to the front end of the chassis frame 19 than the pivot connection B irrespective of whether the tilt assembly is in a tilting or a non-tilting position. To this end, when the tilt assembly 1 is mounted to the powered wheelchair 11, the pivot connection A is located closer to the front end of the powered wheelchair 11 than the pivot connection B.

The powered wheelchair 15 furthermore comprises a seat assembly 21, comprising a seat 21*a* and a backrest 21*b*. The seat assembly 21 is mounted to the tilt frame 7. In particular, the seat assembly 21 is fixedly mounted on top of the tilt frame 7, to the essentially planar surface 7*a* shown in FIG. 1. The tilt assembly 1 and the seat assembly 21 form a seating system of the powered wheelchair 15.

By moving the lifting member 5 and/or by maneuvering the actuator arm 9, various tilting and lifting positions of the seat assembly 21 may be provided.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A tilt assembly for a powered wheelchair, comprising:

an elongated base member provided with an axial channel, a motorized lifting member configured to be received by the base member and to move rectilinearly in the channel, between a retracted position and an extended position relative to the base member, a tilt frame pivotally connected directly to the motorized lifting member, the tilt frame being configured for mounting a seat assembly thereto, and an actuator arm pivotally connected directly to the base member and to the tilt frame, the actuator arm being configured to be actuated between a retracted actuator position and a fully extended actuator position, wherein the tilt frame is configured to obtain a perpendicular orientation relative to a central axis of the motorized lifting member when the motorized lifting member is in the retracted position and the actuator arm is in the retracted actuator position and to be inclined relative to the central axis when the motorized lifting member is in an extended position and the actuator arm is in the retracted actuator position, to thereby provide a tilt functionality.

2. The tilt assembly of claim 1, wherein the tilt frame is configured to obtain an inclined position relative to the central axis when the motorized lifting member is in the retracted position and the actuator arm is in an extended position.

3. The tilt assembly of claim 1, wherein the tilt frame is configured to obtain a perpendicular orientation relative to the central axis when the motorized lifting member is in a fully extended position and the actuator arm is in the fully extended actuator position.

4. The tilt assembly of claim 1, wherein the base member is configured to be immovably mounted to a chassis frame of a powered wheelchair.

5. The tilt assembly of claim 1, wherein the actuator arm has a first end which is pivotally connected to the base member and a second end which is pivotally connected to the tilt frame.

6. The tilt assembly of claim 1, wherein the tilt frame has an essentially planar surface configured for mounting a seat assembly of a powered wheelchair thereto.

7. The tilt assembly of claim 1, wherein the pivot connection between the motorized lifting member and the tilt frame is aligned with a central axis of the motorized lifting member.

8. The tilt assembly of claim 1, wherein the actuator arm is configured to provide a controlled degree of tilt per height unit of movement of the motorized lifting member.

9. A powered wheelchair comprising:

a chassis frame, and a tilt assembly comprising:

an elongated base member provided with an axial channel, a motorized lifting member configured to be received by the base member and to move rectilinearly in the channel, between a retracted position and an extended position relative to the base member, a tilt frame pivotally connected directly to the motorized lifting member, the tilt frame being configured for mounting a seat assembly thereto, and an actuator arm pivotally connected directly to the base member and to the tilt frame, the actuator arm being configured to be actuated between a retracted actuator position and a fully extended actuator position, wherein the tilt frame is configured to obtain a perpendicular orientation relative to a central axis of the motorized lifting member when the motorized lifting member is in the retracted position and the actuator arm is in the retracted actuator position and to be inclined relative to the central axis when the motorized lifting member is in an extended position and the actuator arm is in the retracted actuator position, to thereby provide a tilt functionality.

10. The powered wheelchair of claim 9, wherein the base member is immovably mounted to the chassis frame.

11. The powered wheelchair of claim 10, wherein the base member has a central axis which is oriented vertically when the powered wheelchair is arranged horizontally on a planar surface.

12. The powered wheelchair of claim 9, comprising a seat assembly, wherein the seat assembly is mounted to the tilt frame.

* * * * *